United States Patent [19]

LaPointe

[11] 4,258,632

[45] Mar. 31, 1981

[54] INDIVIDUAL SAFE KEEPING BOX

[75] Inventor: LaPointe, St-Bruno, Canada

[73] Assignee: Rolland Miville, Ville LaSalle, Canada

[21] Appl. No.: 972,920

[22] Filed: Dec. 26, 1978

[51] Int. Cl.[3] ..... E05G 1/026

[52] U.S. Cl. ..... 109/59 R; 49/382; 49/389; 109/52; 109/73

[58] Field of Search ..... 109/50, 51, 52, 56, 109/58, 59, 64, 70, 73; 49/382, 389, 465

[56] References Cited

U.S. PATENT DOCUMENTS

| | | | |
|---|---|---|---|
| 159,897 | 2/1875 | Butler | 109/56 |
| 1,105,826 | 8/1914 | Norton | 49/389X |
| 1,624,305 | 4/1927 | Anderson | 109/56 |
| 2,465,057 | 3/1949 | Brandes | 109/51 |
| 3,629,972 | 12/1971 | Rehberg | 49/382 X |
| 3,715,998 | 2/1973 | Teleky | 109/58 |
| 3,741,132 | 6/1973 | Blower | 109/52 |
| 4,051,790 | 10/1977 | Meditz | 109/58 |

*Primary Examiner*—David H. Corbin

*Attorney, Agent, or Firm*—Robic, Robic & Associates

[57] ABSTRACT

An individual safekeeping box comprising a protective enclosure with an access opening, a protective door with a lock therein, and cooperating mounting means of the door and the enclosure to removably mount the door on the enclosure to close the opening. The enclosure is preferably made in two parts, a top cover and a bottom plate. Means are provided for detachably connecting the top cover and bottom plate together and for locking the connected parts together.

5 Claims, 6 Drawing Figures

INDIVIDUAL SAFE KEEPING BOX

The present invention relates to a safekeeping box.

The invention more particularly relates to an individual safekeeping box having a readily removable lock.

Numerous safekeeping boxes for storing valuables are already known. The boxes generally comprise a secure enclosure with an access opening, a door to close the access opening, and a lock in the door or enclosure to lock the door in a closed position. Individual safekeeping boxes are also known and sometimes provided in hotel or motel rooms so that the room occupants can store their valuables in the box while staying in the room. The boxes are securely fastened by suitable means in the rooms so they cannot be removed. The room occupant obtains a key for the lock on the box at the same time that he receives his room key.

A major disadvantage in using individual safekeeping boxes in hotel and motel rooms is that a thief can rent a room, make impressions of both room and safekeeping box keys, make duplicate keys from the impressions and then return to rob valuables when another person occupies the room and uses the safekeeping box therein to store his own valuables. For this reason, the idea of providing a system of individual safekeeping boxes in hotel and motel rooms has up to now not enjoyed too much success.

Another disadvantage of known individual safekeeping boxes is that it is often difficult to securely mount the boxes so that they cannot be readily removed from the room.

It is an object of the present invention to provide an individual safekeeping box which is constructed in a manner which substantially reduces the risks of theft of the contents of the box.

It is another object of the invention to provide an individual safekeeping box which is constructed in a manner to reduce the risks of theft of the box itself.

It is a further object of the present invention to provide an improved system of individual safekeeping boxes which is more theft-proof than any known system of safekeeping boxes and therefore can be effectively employed in hotels, motels, and the like.

In accordance with the present invention, these objects are achieved with an individual safekeeping box provided with a removable, interchangeable door. A box can be securely mounted in each room of a hotel or motel. The doors for the boxes are kept at the check-in desk of the hotel or motel, however. Each door, or group of doors, has a different lock requiring a key which is different from that of the other doors or group of doors. Each door can be easily, securely mounted in any of the boxes. When a person checks into a room, he receives a door, and its associated key, for the box in his room. When the occupant checks out, he also turns in the door and the associated key. The next occupant will receive a different door and its own associated key. Thus it is of little use for a thief to check into a room and to take an impression of the room key and box key, since when he checks out he will have to turn in the lock on his box and he will not know to what room the lock he has a key impression of will be next assigned.

The individual safekeeping boxes according to the present invention each comprise a protective enclosure with an access opening, a protective door with a lock therein, and cooperating mounting means on the door and the enclosure to removably mount the door on the enclosure to close the opening.

As can be easily understood, it is the doors of the boxes that are checked out rather than the keys of the individual locks.

In accordance with a preferred embodiment of the invention, each box is constructed in two main parts, and means are provided for simply connecting the two parts together. The construction permits the box to be securely mounted in a simple manner.

In accordance with this preferred embodiment, the enclosure is made in two parts comprising a bottom plate part and a top cover part, and means are provided for connecting the parts together and for locking the connected parts together.

The system of individual safekeeping boxes according to the present invention comprises a plurality of individual safekeeping boxes, each box comprising a protective enclosure having an access opening of a predetermined size, a plurality of interchangeable protective doors for closing the access openings, each door and enclosure comprising cooperating mounting means for removably mounting any door on any enclosure, and a plurality of locks, one on each door, said locks on the doors, or groups of doors, being different from each other.

The invention will now be described in detail having reference to the accompanying drawings in which.

Figure 1:
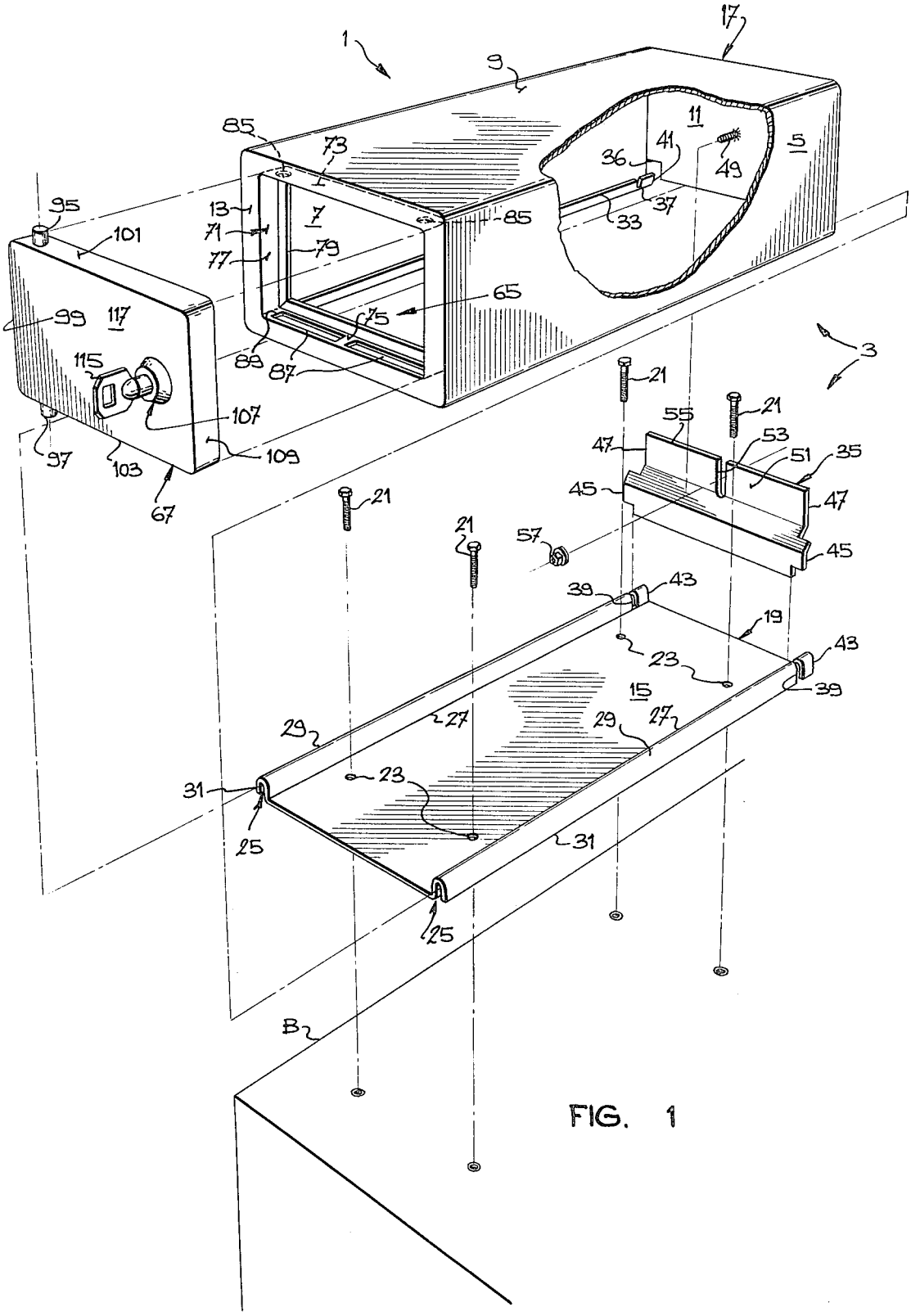
FIG. 1 is an exploded perspective view of an embodiment of safekeeping box according to the invention.

The safekeeping box 1 shown in FIG. 1 has a protective enclosure 3. The enclosure 3 has a rectangular shape with side walls 5 and 7, a top wall 9, a back wall 11, a front wall 13 and a bottom wall 15, all bolted, welded or otherwise joined to each other in a conventional manner. The enclosure 3 is made in two parts, a top cover part 17 and a bottom plate part 19. The bottom plate part 19, which includes bottom wall 15, is separate from the remaining walls which form the unitary top cover part 17.

The separate bottom plate part 19 permits the enclosure 3 to be securely mounted to a solid base "$\beta$". The base "$\beta$" can be a masonary structure on which the bottom part 19 of the enclosure is securely fastened by a set of masonary bolts 21 passing through a corresponding set of holes 23 in the bottom wall 15. The top cover part 17 is then attached to the securely fastened bottom part 19 to form the secure enclosure 3.

Means are provided for easily connecting and locking the cover and bottom parts 17 and 19 together. These connecting means include a set of downwardly facing grooves 25 provided in the bottom part 19, which grooves extend along the long sides 27 of the bottom wall 15. Each groove 25 can be formed by bending a side portion of the bottom part 19 adjacent the bottom wall, up, over, and then down to form an inverted, U-shaped rib 29. The free edges 31 of the bent side portions or ribs 29 are located slightly above the plane of the bottom wall 15 as shown in FIG. 5.

Figure 5:
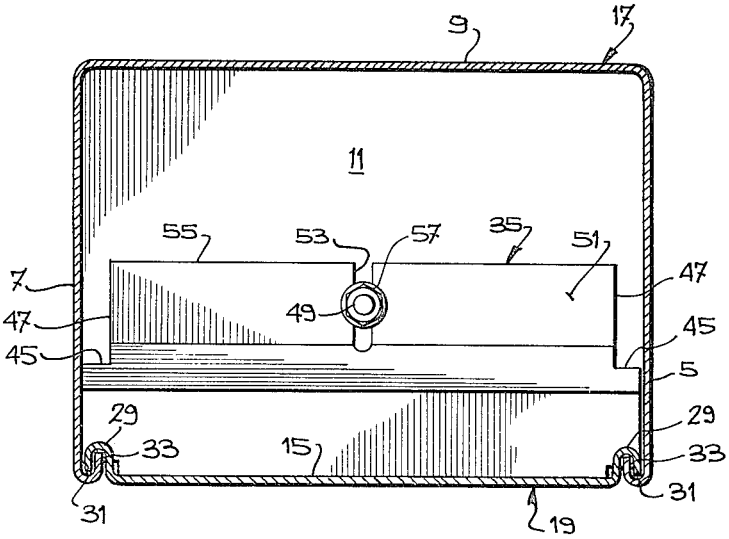
FIG. 5 is a cross-section view of the box shown in FIG. 1, looking toward its back wall.

The bottom portions of the sidewalls 5 and 7 of the top cover part 17 are symmetrically bent inwardly and upwardly to form a set of flanges 33, as shown in FIG. 5. The top cover part 17 is connected to the securely fastened part 19 by sliding it onto the bottom part 19. For this purpose, cut-outs 36 are provided in the lower corners of the backwall 11 to pass the ribs 29 when sliding the cover 17 on the plate 19. The flanges 33 slide snugly into the grooves 25 formed by the ribs 29 to connect the top and bottom enclosure parts 17 and 19 securely together.

Means are provided within the enclosure 3 to lock the two connected enclosure parts 17 and 19 together. These locking means comprise a locking member 35, shown in FIG. 1, mounted within the enclosure and movable to cooperate with a set of slots 37 provided in the flanges 33 and with another of slots 39 provided in the ribs 29 to lock the parts together. The slots 37 are provided in each flange 33 in the cover part 17 adjacent the back edge 41 of the flange. The slots 39 are provided in each rib 29 in the bottom part 19 adjacent the rib back edge 43. The slots 37 and 39 are located so as to be aligned when the top cover part 17 is properly mounted on the bottom plate part 19.

The locking member 35 has a pair of opposed tabs 45 projecting from its sides 47, which tabs fit into the aligned slots 37 and 39 on each side of the enclosure to securely lock the two enclosure parts together against longitudinal movement. The locking member 35 itself is fixed to the back wall 11 of the enclosure 3. A threaded pin 49 projects into the enclosure 3 from the back wall 11. The locking member 35 has a flange portion 51 which lies flush against the back wall when the tabs 45 are within the slots 37 and 39. A vertical slot 53 is provided in the flange 51 which slot extends down from the top edge 55 of the flange 51 to receive the pin 49. A nut 57 threads on the pin 49 to clamp the locking member 35 in its locked position. When the nut 57 is loosened, the member 35 can be moved up within the enclosure along the back wall 11 to move the tabs 45 out of slots 37, 39 and thus to unlock the two enclosure parts 17 and 19 so that they can slide apart. The locking member 35 can be formed from a plate cut to provide the tabs 45 projecting from its sides 47, and bent to offset the flange 51 from the tabs 45.

The front wall 13 of the enclosure 3 is provided with an access opening 65 as shown in FIG. 1, which is preferably rectangular in shape. A separate door 67 is provided to close the opening 65 in the enclosure 3. The door 67 is constructed so it can be readily, yet securely and detachably mounted on the enclosure to close the opening 65. Cooperating mounting means are provided on both the door 67 and the enclosure 3 to detachably mount the door.

In more detail, the front wall 13 includes a framing wall 71 extending into the enclosure 3 perpendicularly from the front surface of the front wall 13, to frame the opening 65. The framing wall 71 has top and bottom sections 73 and 75 and two side sections 77. A narrow flange 79 extends into the opening 65 from the back or inner edge of the framing wall 71 to provide a door stop. At least one, and preferably two, door mounting means are provided in the framing wall 71. The two mounting means are located on opposite sides of the opening 65. Each door mounting means comprises a hinge hole 85 in the top framing wall section 73 adjacent one side section 77, and a hinge slot 87 in the bottom framing wall section 75. The slot 87 has one end 89 located beneath the hole 85 and extends toward the center of the bottom wall section 75.

The door 67 has a thickness substantially equal to the width of the framing wall 71 and is provided with a pair of aligned hinge pins 95 and 97 adjacent one side edge 99 of the door, which pins project perpendicularly from the top and bottom edges 101 and 103 of the door. The pin 95 is sized to fit loosely in the mounting hole 85 while the pin 97 is sized to fit loosely in the slot 87.

Figure 2:
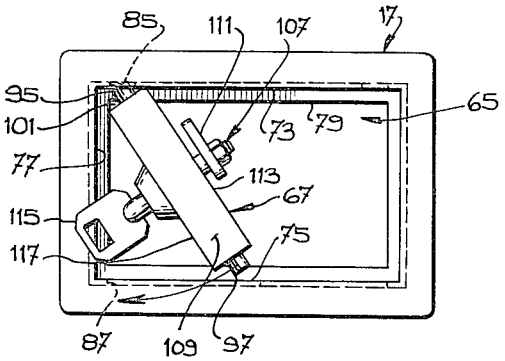
FIG. 2 is a front view of the box shown in FIG. 1 showing the door of the box being mounted therein.
Figure 3:
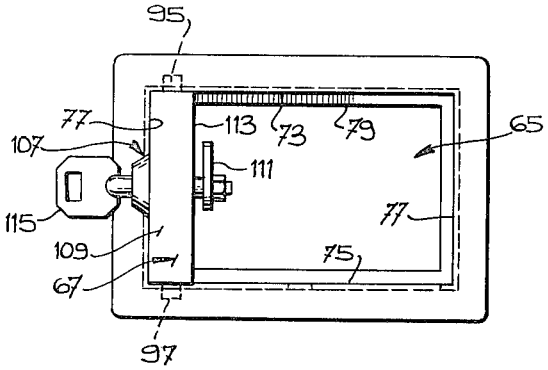
FIG. 3 is a front view of the box shown in FIG. 1 with the door mounted therein.
Figure 4:
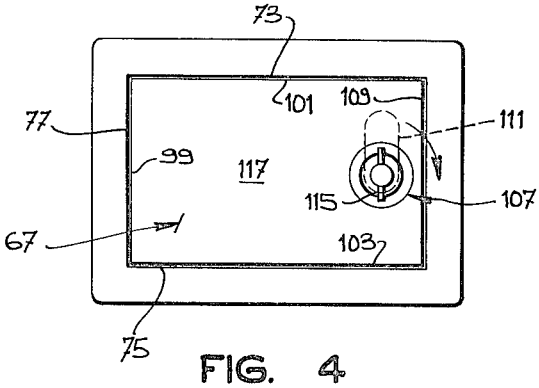
FIG. 4 is a front view of the box shown in FIG. 1, with the door closed.

As shown in FIG. 2, the door 67 is detachably mounted in the enclosure 3 by holding the door at an angle with respect to the opening 65 so it can be slid, its side edge 99 first, into the opening to locate the top hinge pin 95 under the hole 85. The door is then moved to place the pin 95 in the hole 85, and the door is then rotated about the pin 95 to move the bottom pin 97 into the slot 87 while bringing the door edge 99 parallel to one side wall section 77 of the opening 65, as shown in FIG. 3. The door 67 is now mounted so that it can pivot on the pins 95 and 97 to close the opening 65, while fitting snug within the framing wall 71 against the stop flange 79, and flush with the enclosure front wall 13.

With mounting means provided on each side of opening 65, the door 67 can be mounted on either side of the opening.

Means are provided to lock the door in a closed position. For this purpose, a lock 107 is mounted in the door adjacent the side edge 109 opposite the side edge 99. The lock 107 has a rotatable latch 111 adjacent but slightly spaced from the inner wall 113 of the door. The latch 111 is so located that, when the lock 107 is operated by a key 115 from the outer wall 117 of door 67, the latch 111 rotates to move behind the stop flange 79 to lock the door.

The door 67 can be easily removed when use of the box is finished, by opening the door perpendicular to the front wall 13 and then turning or rotating it about the pin 95 to move the pin 97 out of the slot 87, and then moving the pin 95 down out of the hole 85. While the latch 111 has been located to lock behind the stop flange 79, it could also lock in a slot provided in the framing wall 71.

A separate enclosure 3 can be provided in each room of a hotel or motel for use by a guest. Each enclosure 3 is securely fastened in place in the room via the bottom plate 19, and the top cover 17 is securely locked to the plate 19 via locking member 35. The door 67 for each enclosure 3, and the key 115 for the lock 107 in the door, are kept at the check-in desk of the hotel or motel. Each lock, or each group of locks, is different from the other locks or other groups of locks, requiring a different key to operate it. If the guest wishes to store valuables in his room he checks out a door, and a key for the door, at the same time that he checks in. The door is installed on the enclosure in his room to provide a safe-keeping box for his valuables. The door is returned when the guest checks out. The next guest who wishes to store valuables in that same room will receive a different door having a different lock and key.

Figure 6:
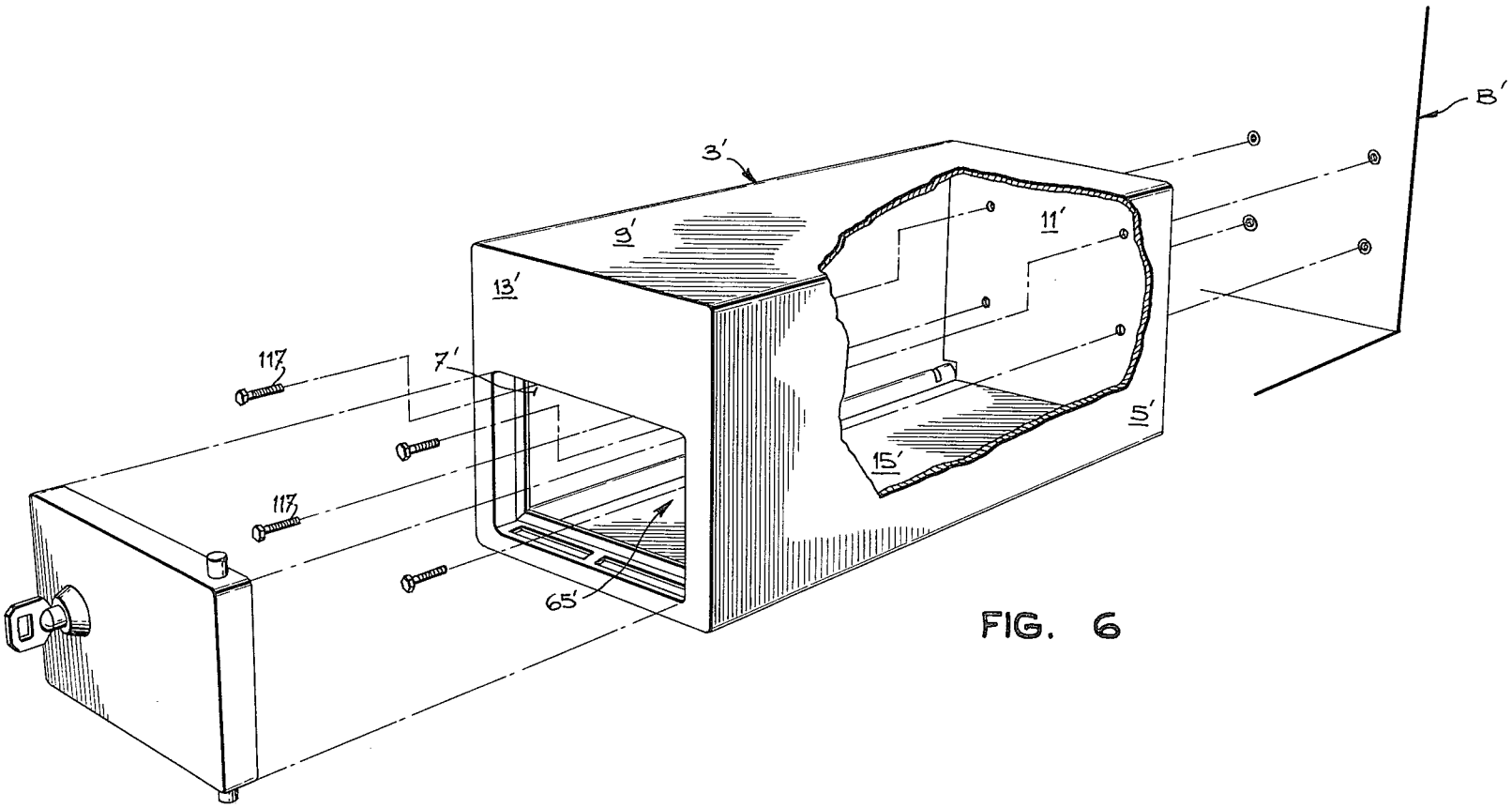
FIG. 6 is an exploded perspective view of another embodiment of safekeeping box according to the invention.

While the enclosure 3 has been perferably described as being made in two parts, it can also be made in one piece 3' with side walls 5' and 7', top wall 9', back wall 11', front wall 13', and bottom wall 15' integrally joined together (see FIG. 6). The enclosure 3' is fixed to a solid support base 8' via fastening devices 117 passing through its back wall 11′ as shown in FIG. 6. Access to fasteners 117 is through opening 65′.

Of course, both the door 67 and enclosure 3 are made from suitable heavy guage steel or similar, strong protective material.

I claim:

1. An individual safekeeping box, comprising:

a protective enclosure having an access opening, said access opening having first and second spaced, opposed framing wall sections, and said enclosure comprising a top cover part and a bottom plate part, cooperating means on the two parts for detachably connecting them together, and locking means for locking the two connected parts together, said cooperating connecting means comprising a rib on each side of the bottom plate part, said rib forming a connecting groove, and a flange on the bottom edge of each side of the top cover part for sliding in the grooves to slidably connect the bottom plate part and the top cover part together;

a protective door for closing said access opening, said door being receivable within said access opening in a snug relationship and having first and second edge portions spaced apart a distance slightly less than the spacing between said first and said second framing wall sections;

cooperating means on said door and said enclosure for detachably mounting said door onto said enclosure, said first framing wall section having a hinge hole therein and said second framing wall section having a hinge slot therein disposed to confront said hinge hole, and said cooperating mounting means including:

a first projecting hinge pin mounted on said first edge portion of said door; and a second projecting hinge pin mounted on said second edge portion of said door in general alignment with said first hinge pin, said first and second hinge pins projecting in opposite directions, and the axes thereof defining a pivot axis for said door;

whereby said door can be detachably mounted on said enclosure by holding the door at an angle with respect to said opposed first and second framing sections and sliding it into said access opening, seating said first hinge pin in said hinge hole, and then rotating said door about said first hinge pin to seat said second hinge pin in said hinge slot, whereupon said door can be pivoted between open and closed positions about said pivot axis; and a lock carried by said door, for locking said door to said enclosure after said door has been pivoted to its closed position.

2. An individual safekeeping box as claimed in claim 1, wherein the locking means comprise a locking plate slidably connected to the interior of the top cover part, and slots in both the ribs and the flanges to slidably receive the locking plate when the rib and flange slots are aligned, to prevent relative sliding movement between the connected top cover part and the bottom plate part.

3. An individual safekeeping box, comprising:

a protective enclosure having a rectangular access opening, said access opening having first and second spaced, opposed framing wall sections;

a rectangular protective door for closing said access opening, said door being receivable within said rectangular access opening in a snug relationship and having first and second edge portions spaced apart a distance slightly less than the spacing between said first and said second framing wall sections;

cooperating means on said door and said enclosure for detachably mounting said door onto said enclosure, said first framing wall section having a hinge hole therein and said second framing wall section having a hinge slot therein disposed to confront said hinge hole, said hinge hole being disposed near one end of said first framing wall section and having about the same dimension measured either transversely or longitudinally of said first framing wall section, said hinge slot having a dimension measured longitudinally of said second framing wall section that is substantially greater than the dimension of said hinge slot measured transversely of said second framing wall section, and said hinge hole and said hinge slot each having a substantially continuous periphery, and said cooperating means including:

a first projecting hinge pin mounted on said first edge portion of said door, and having a diameter such that it is loosely receivable within said hinge hole; and a second projecting hinge pin mounted on said second edge portion of said door in general alignment with said first hinge pin and having a diameter less than the dimension of said hinge slot measured transversely of said second framing wall section, said first and second hinge pins projecting in opposite directions, and the axes thereof defining a pivot axis for said door;

whereby said door can be detachably mounted on said enclosure by holding the door at an angle with respect to said opposed first and second framing sections and sliding it into said access opening, seating said first hinge pin in said hinge hole, and then rotating said door about said first hinge pin to seat said second hinge pin in said hinge slot so that said pivot axis formed by said aligned hinge pins lies at a right angle to said first and second framing sections, whereupon said door can be pivoted between open and closed positions about said pivot axis; and a lock carried by said door, for locking said door to said enclosure after said door has been pivoted to its closed position.

4. An individual safekeeping box as claimed in claim 3, including a pair of hinge holes in said first framing wall section, one at each end thereof, and a pair of hinge slots in said second framing wall section, one at each end thereof, whereby said door can be mounted in said access opening with said pivot axis disposed at either end thereof.

5. An individual safekeeping box as claimed in claim 3, wherein the enclosure comprises a top cover part and a bottom plate part, cooperating means on the two parts for detachably connecting them together, and locking means for locking the two connected parts together.

* * * * *